US008924139B2

(12) United States Patent
Louis et al.

(10) Patent No.: US 8,924,139 B2
(45) Date of Patent: Dec. 30, 2014

(54) COLLISION PREVENTION DEVICE AND METHOD FOR A VEHICLE ON THE GROUND

(75) Inventors: Xavier Louis, Goyrans (FR); Didier Lorido, Plaisance du Touch (FR); Nicolas Marty, Saint Sauveur (FR)

(73) Assignee: Thales, Neuilly-sur-Seine (FR)

( * ) Notice: Subject to any disclaimer, the term of this patent is extended or adjusted under 35 U.S.C. 154(b) by 1351 days.

(21) Appl. No.: 12/133,537

(22) Filed: Jun. 5, 2008

(65) Prior Publication Data

US 2008/0306691 A1 Dec. 11, 2008

(30) Foreign Application Priority Data

Jun. 5, 2007 (FR) ..... 07 04010

(51) Int. Cl.

| | |
|---|---|
| ***G08G 1/16*** | (2006.01) |
| ***G08G 5/04*** | (2006.01) |
| ***G08G 5/06*** | (2006.01) |
| ***G08G 5/00*** | (2006.01) |

(52) U.S. Cl.

CPC ..... *G08G 5/06* (2013.01); *G08G 5/045* (2013.01); *G08G 5/065* (2013.01); *G08G 5/0021* (2013.01)

USPC ..... 701/301

(58) Field of Classification Search

CPC ..... G08G 1/16; G08G 1/163; G08G 1/166; G01S 13/931; B60W 30/09

See application file for complete search history.

(56) References Cited

U.S. PATENT DOCUMENTS

| | | | | |
|---|---|---|---|---|
| 6,314,363 | B1 | 11/2001 | Pilley et al. | |
| 6,683,541 | B2 * | 1/2004 | Staggs et al. | 340/961 |
| 2003/0149530 | A1 | 8/2003 | Stopczynski | |
| 2004/0225440 | A1 * | 11/2004 | Khatwa et al. | 701/301 |
| 2005/0171654 | A1 | 8/2005 | Nichols et al. | |
| 2007/0080848 | A1 | 4/2007 | Stone et al. | |

OTHER PUBLICATIONS

Cassell R et al: "Patuprox-A Runway Incursion Alerting System"; Digital Avionics Systems Conferences, 2000. Proceedings. DASC. The 19th Oct. 7-13, 2000, Piscataway, NJ, USA, IEEE. vol. 2, Oct. 7, 2000, pp. 7D31-7D36, XP010522793; ISBN: 0-7803-6395-7.

* cited by examiner

*Primary Examiner* — Michelle L Le

(74) *Attorney, Agent, or Firm* — Lowe Hauptman & Ham, LLP

(57) ABSTRACT

Described are a collision prevention device and a method for a vehicle in motion on the ground. The collision prevention device includes means for localizing obstacles; means for acquiring obstacle localization data; means for localizing the equipped vehicle; a collision prevention computer, and presentation means for presenting warnings to a driver of the equipped vehicle.

57 Claims, 11 Drawing Sheets

COLLISION PREVENTION DEVICE AND METHOD FOR A VEHICLE ON THE GROUND

RELATED APPLICATIONS

The present application is based on, and claims priority from, French Application Number 07 04010, filed Jun. 5, 2007, the disclosure of which is hereby incorporated by reference herein in its entirety.

BACKGROUND OF THE INVENTION

The present invention relates to a collision prevention device and a method for a vehicle. The device can notably be installed on board an aircraft in order to warn of potential collisions between the aircraft and an object or other vehicle, when the aircraft is on the ground.

The density of airport traffic is on the increase both in the local airspace and on the ground. The reported incidents occurring during aircraft taxiing phases are becoming more frequent, notably when an aircraft is taxiing to an apron from a runway of an airport.

DESCRIPTION OF THE PRIOR ART

In order to overcome these problems of collision, airports are equipped with various means enabling centralized management of the traffic on the ground. These means are notably airport surveillance radar systems and radio means for communicating with taxiing aircraft crew. The surveillance radar systems notably allow all of the mobile elements moving over an airport surface to be localized. The localization information, potentially coupled with positioning information transmitted by the taxiing aircraft, can allow forewarning of accident-causing situations.

Amongst the anti-collision means used in flight, a TCAS or Traffic Collision Avoidance System is notably used. The TCAS system is a collaborative means installed on board some aircraft. The TCAS is referred to as a collaborative means because it is based on a mutual collaboration of the aircraft via an exchange of data. In actual fact, the TCAS uses a transponder installed on board a first aircraft which transmits the current heading and speed of the first aircraft to the other aircraft. Each aircraft receiving the heading and speed information from the other aircraft can establish its own heading and safety distance relative to the other aircraft having broadcast this information. In the case of an approach of the other aircraft incompatible with the path of the first aircraft, the TCAS warns the crew of the aircraft of a dangerous proximity with another aircraft. The TCAS takes into account safety margins between the aircraft in order to decide whether or not to alert the crew to a dangerous proximity. When the aircraft is in flight, the TCAS may suggest inverse avoidance maneuvers to the two aircraft in dangerous proximity.

Another system, the ADS-B denoting Automatic Dependant Surveillance Broadcast allows various parameters to be transmitted automatically. The ADS-B, also installed on board an aircraft, notably transmits the identification of the aircraft, its position, its route and its speed for monitoring applications. The transmission of the various parameters is carried out via a data link to non-specific recipients which can be other aircraft, ground stations or vehicles on the ground. The potential recipients have the choice whether or not to reject the messages received. The ADS-B could also be coupled to a TCAS in order to warn of possible collisions.

A system complementary to the two aforementioned means, the TIS-B or Traffic Information Service Broadcast, allows radar information to be retransmitted via a data link to all vehicles notably equipped with an ad hoc receiver. The radar information notably relates to the positions of various vehicles on surface of an airport. The positions are for example obtained by triangulation using several radar antennas situated at the airport. However, not all airports do have such equipment.

Furthermore, the various TCAS, ADS-B, etc. systems are not present on all of the vehicles. Notably light aircraft or runway vehicles are not always equipped with these. These systems also suffer from the lack of standardization of the information communicated.

Moreover, depending on the source of information used, which may be a TCAS, ADS-B or TIS-B system, all of the information may be transmitted with a certain delay associated with filtering processes and with calculations performed on board the aircraft or other vehicles.

When a vehicle is in motion over an airport surface, the low speed of travel associated with a necessary density of the aircraft and of the service vehicles mean that the safety margins correspond to relatively short distances. These distances, of the order of ten meters, are generally of the same order of magnitude as the uncertainties in the relative positions obtained by taking into account position information received via the ADS-B for example. In fact, the uncertainties in the quality of the information received do not always allow a level of safety to be guaranteed for use by an anti-collision function. The role of an anti-collision function is indeed to ensure a sufficient level of safety for an aircraft in motion, without triggering too high a number of collision alerts. One tendency in anti-collision functions is to increase the safety margins in order to compensate for the low quality of the position measurements. This has the drawback of triggering false collision alerts which lead to a loss of confidence in the anti-collision function by the flight crew. The anti-collision function then becomes inoperative to the detriment of the safety of the aircraft taxiing on the ground and of its passengers.

SUMMARY OF THE INVENTION

One goal of the invention is notably to overcome the aforementioned drawbacks. For this purpose, the subject of the invention is a device for preventing collisions between a vehicle in motion on the ground, carrying the said collision prevention device, and obstacles.

The collision prevention device can comprise:

- means for localizing obstacles;
- means for acquiring obstacle localization data;
- means for localizing the equipped vehicle;
- a collision prevention computer notably carrying out the following processing operations:
  - combining the obstacle localization data coming from the acquisition means;
  - taking into account a description of a configuration of the equipped vehicle and also the localization of the equipped vehicle;
  - detection of the proximity conflicts between the equipped vehicle and the localized obstacles;
  - generation of alerts in the case of proximity of the equipped vehicle and a localized obstacle;
  - generation of at least one solution for resolving each conflict detected;
- means for presenting, notably warnings, to a driver of the equipped vehicle.

The collision prevention computer can use topographical data stored for example in a mapping database.

The localization means of the equipped vehicle notably supply localization and kinematics information on the equipped vehicle to the collision prevention computer.

The description of the configuration of the equipped vehicle is for example a space-occupation circle of the vehicle. The size of the space-occupation circle is notably a function of the length and the width of the vehicle.

The description of the configuration of the equipped vehicle is for example stored in a vehicle configuration database.

The collision prevention computer can generate at least one conflict resolution solution.

The collision prevention device can comprise a braking and steering system. The braking and steering system notably implements a conflict resolution solution.

The collision prevention computer can generate various levels of alerts.

A first level of alert notably warns the driver of the vehicle that a first safety distance between the vehicle and an obstacle has been breached.

A second level of alert notably warns the driver of the vehicle that a second safety distance, less than the first safety distance between the vehicle and an obstacle, has been breached.

A third level of alert notably warns the driver of the vehicle that he must immediately trigger an action to avoid an obstacle, the distance between the vehicle and an obstacle being less than a third distance, less than the second distance.

In third level of alert notably warns a driver of the vehicle that a conflict resolution solution is implemented by the braking and steering system, the distance between the vehicle and an obstacle being less than a third distance, less than the second distance.

The collision prevention computer can generate a first conflict resolution solution, with low deceleration rate. The collision prevention computer can, in this case, propose a first speed to the driver of the vehicle to be applied and to be maintained in order to comply with a first safety distance between the vehicle and an obstacle.

The collision prevention computer can generate a second solution, with intermediate deceleration rate. The collision prevention computer notably proposes a second speed to the driver of the vehicle to be applied and to be maintained in order to comply with a second safety distance, less than the first safety distance, between the vehicle and an obstacle.

The collision prevention computer can generate a third solution, with a high braking rate. The collision prevention computer notably proposes a third speed to the driver of the vehicle to be immediately applied in order to ensure the avoidance of an obstacle. The distance between the vehicle and an obstacle can, in this case, be less than a third distance less, for example, than the second safety distance.

The collision prevention computer can generate a third solution, with a high braking rate. The third solution can be implemented by the braking and steering system. The distance between the vehicle and an obstacle can, in this case, be less than a third distance less, for example, than the second safety distance.

A means for acquisition of obstacle localization data can be a traffic computer carrying out a data acquisition for localization and identification of the obstacles. The localization and identification data can come from systems remote from the equipped vehicle.

A means for acquisition of obstacle localization data can be a detection data management system.

The detection data management system notably identifies the obstacles detected.

The localization means are for example radar localization means.

The radar systems are for example distributed over the equipped vehicle.

The information presentation means notably present the obstacles, the proximity conflicts, the topographical data, the alerts, the conflict resolution solutions and a representation of the vehicle.

The information presentation means notably present an indication of the type of data that has enabled the identification of the obstacle. The type of data is for example:

- data coming from a detection data management system;
- data coming from a traffic computer;
- data coming from a detection data management system combined with data coming from a traffic computer.

The information presentation means notably present information on the inter-distance between the vehicle and an obstacle detected.

The information presentation means notably present information on the variation with time of the inter-distance between the vehicle and an obstacle.

The vehicle is for example an aircraft moving over an airport surface.

The aircraft is for example a pilotless aircraft.

A system remote from the vehicle is for example a TCAS, acronym for Traffic Collision Avoidance System.

A system remote from the vehicle is for example an ADS-B system, acronym for Automatic Dependant Surveillance Broadcast.

A system remote from the vehicle is for example a TIS-B system, acronym for Traffic Information Service Broadcast.

A further subject of the invention is a collision prevention method for a vehicle in motion on the ground. The method comprises at least the following steps:

- acquisition of obstacle localization data coming from various localization sources;
- combination of the obstacle localization data for each localized obstacle;
- detection of conflicts between the localized obstacles and the vehicle as a function of a geometrical description of the vehicle;
- generation of alerts in the case of a conflict being detected;
- generation of a conflict resolution solution upon generation of an alert.

The method can comprise a step for acquisition of identification information on the localized obstacles.

The conflict detection notably takes into account localization and kinematics information on the vehicle.

The method can comprise a step for automation of resolution solutions. The resolution solution automation step notably implements a braking and steering system of the vehicle.

The localization data can come from a traffic computer.

The localization data can come from a detection data management system for obstacles.

The obstacle detection data can come from at least one radar system, positioned on the equipped vehicle.

The traffic computer can take into account localization data coming from the following systems:

- TCAS, acronym for Traffic Collision Avoidance System;
- ADS-B, acronym for Automatic Dependant Surveillance Broadcast;
- TIS-B, acronym for Traffic Information Service Broadcast.

The conflict detection step can take into account topographical data stored for example in a mapping database.

A geometrical description of the vehicle is for example a space-occupation circle of the vehicle. The size of the space-occupation circle is for example a function of the length and the width of the vehicle. The space-occupation circle is for example stored in a configuration database for the vehicle.

The combination of the localization data can use a weighted sum of the localization data coming, on the one hand, from the traffic computer and, on the other, from the detection data management system.

The weighted sum is for example of the form:

$$P_{MIX}=C\times P_1+(1-C)\times P_2$$

where $P_{MIX}$ is for example a localization data value resulting from the weighted sum of the value $P_1$ of the localization data coming from the detection data management system and of the value $P_2$ of the localization data coming from the traffic computer. C is a weighting criterion.

The weighting criterion C is for example obtained according to the equation:

$$C=\left[\left(\left(\prod_{i=1}^{n}(1+C_i)^{\alpha_i}\right)^{\frac{1}{\sum_{i)1}^{n}\alpha_i}}\right)-1\right]$$

where C is notably a result of a law for mixing a number n of different parameters $C_i$, i being in the range between one and n A settable degree of importance $\alpha_i$ is associated with each parameter $C_i$.

- a first parameter $C_1$ is for example a distance measured between the equipped vehicle and an localized obstacle;
- a second parameter $C_2$ is for example an approach speed between the equipped vehicle and the localized obstacle;
- a third parameter $C_3$ is for example a distance between the equipped vehicle and the localized obstacle, measured on elements of the airport, described by data on the topography over which the equipped vehicle is in motion.

The conflict detection step constructs for example at least one safety envelope as a function of: settable safety margins around the vehicle, the geometrical description of the vehicle, a speed of the vehicle, and a direction of travel of the vehicle. The safety envelope can be deformed according to the variation in the speed of the vehicle and the variation in the direction of travel of the vehicle.

Several levels of alerts can be generated.

A first level of alert for example warns a driver of the vehicle that a first safety distance between the vehicle and an obstacle has been breached.

A second level of alert for example warns the driver of the vehicle that a second safety distance, less than the first safety distance, between the vehicle and an obstacle has been breached.

A third level of alert for example warns the driver of the vehicle that he must trigger an immediate action to avoid an obstacle, the distance between the vehicle and the obstacle being less than a third safety distance, less than the second safety distance.

A third level of alert for example warns the driver of the vehicle that a conflict resolution solution is implemented by the braking and steering system, the distance between the vehicle and an obstacle being less than a third safety distance, less than the second safety distance.

A first conflict resolution solution, with low deceleration rate, for example proposes a first speed to the driver of the vehicle to be applied and to be maintained in order to comply with a first safety distance between the vehicle and an obstacle.

A second solution, with intermediate deceleration rate, for example proposes a second speed to the driver of the vehicle to be applied and to be maintained in order to comply with a second safety distance, less than the first safety distance, between the vehicle and an obstacle.

A third solution, with high deceleration rate, for example proposes a third speed to the driver of the vehicle to be immediately applied in order to ensure the avoidance of an obstacle. The distance between the vehicle and the obstacle is, in this case, less than a third safety distance, for example less than the second safety distance.

A third solution, with high deceleration rate, is for example implemented by the braking and steering system. The distance between the vehicle and an obstacle is, in this case, less than a third safety distance, less than the second safety distance.

The method can comprises a situation presentation step. The situation notably comprises the localized obstacles, the representation of the vehicle, one or more safety envelopes of the vehicle, the topographical data, the alerts and the conflict resolution solutions.

Each obstacle is for example presented with information on the type of data that has enabled the obstacle to be localized. The type of data having enabled the localization is for example:

- data coming from a detection data management system;
- data coming from a traffic computer;
- data coming from a detection data management system combined with data coming from a traffic computer.

Each obstacle is for example presented with information on the inter-distance between the vehicle and the obstacle.

Each information on the inter-distance between the vehicle and an obstacle can be shown with information on the variation with time of the inter-distance.

The vehicle is for example an aircraft moving over an airport surface.

The aircraft is for example a pilotless aircraft.

The major advantage of the invention is notably to provide a reliable localization of obstacles, whether collaborating or not. The reliability of the localization of obstacles allows automation of the implementation of maneuvers for avoidance of the localized obstacles. Advantageously, the device according to the invention allows a separation to be maintained between a vehicle equipped with the said device and an obstacle.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

DETAILED DESCRIPTION

Figure 1A:
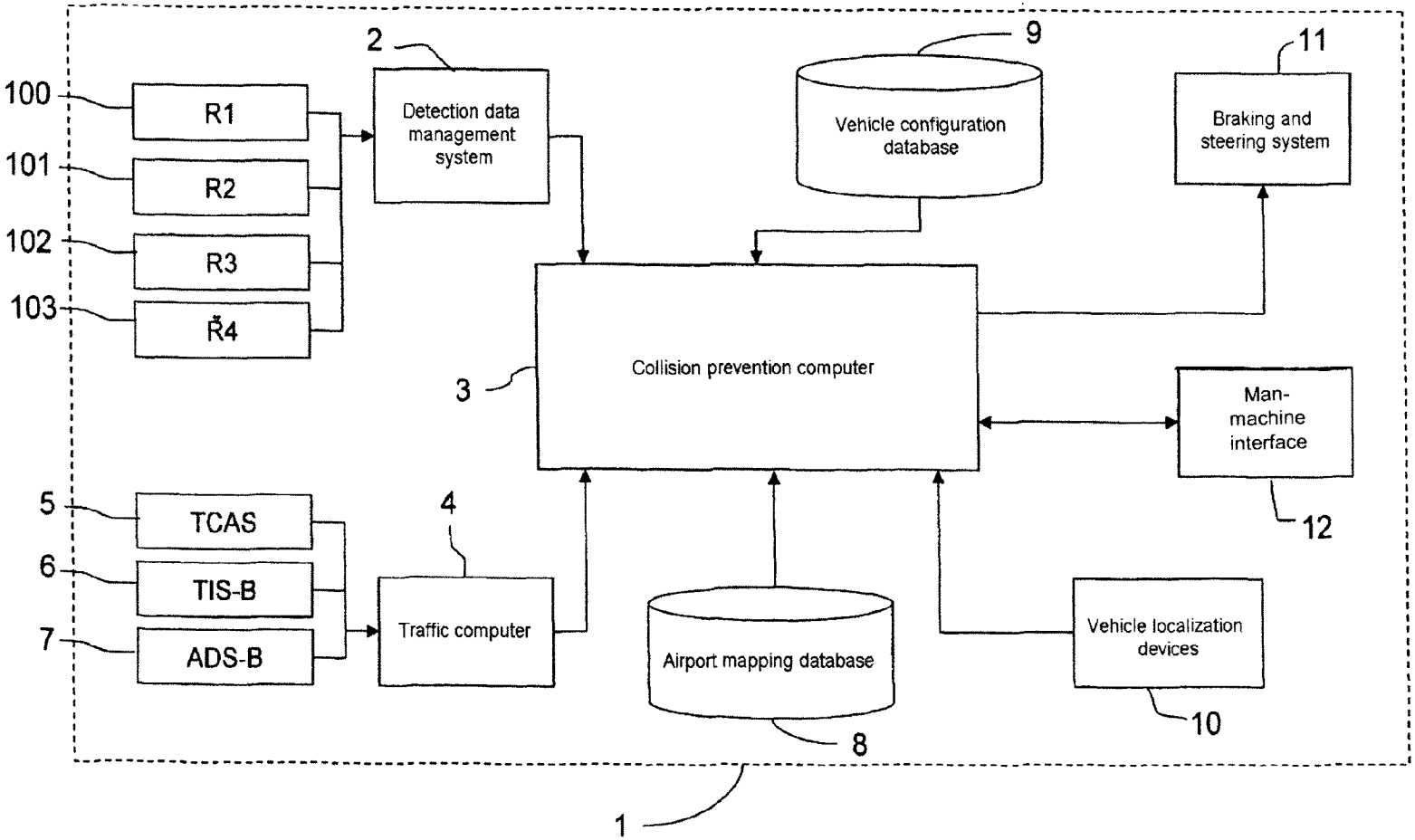
FIG. 1*a*: a schematic representation of a collision prevention device according to the invention.
Figure 1B:
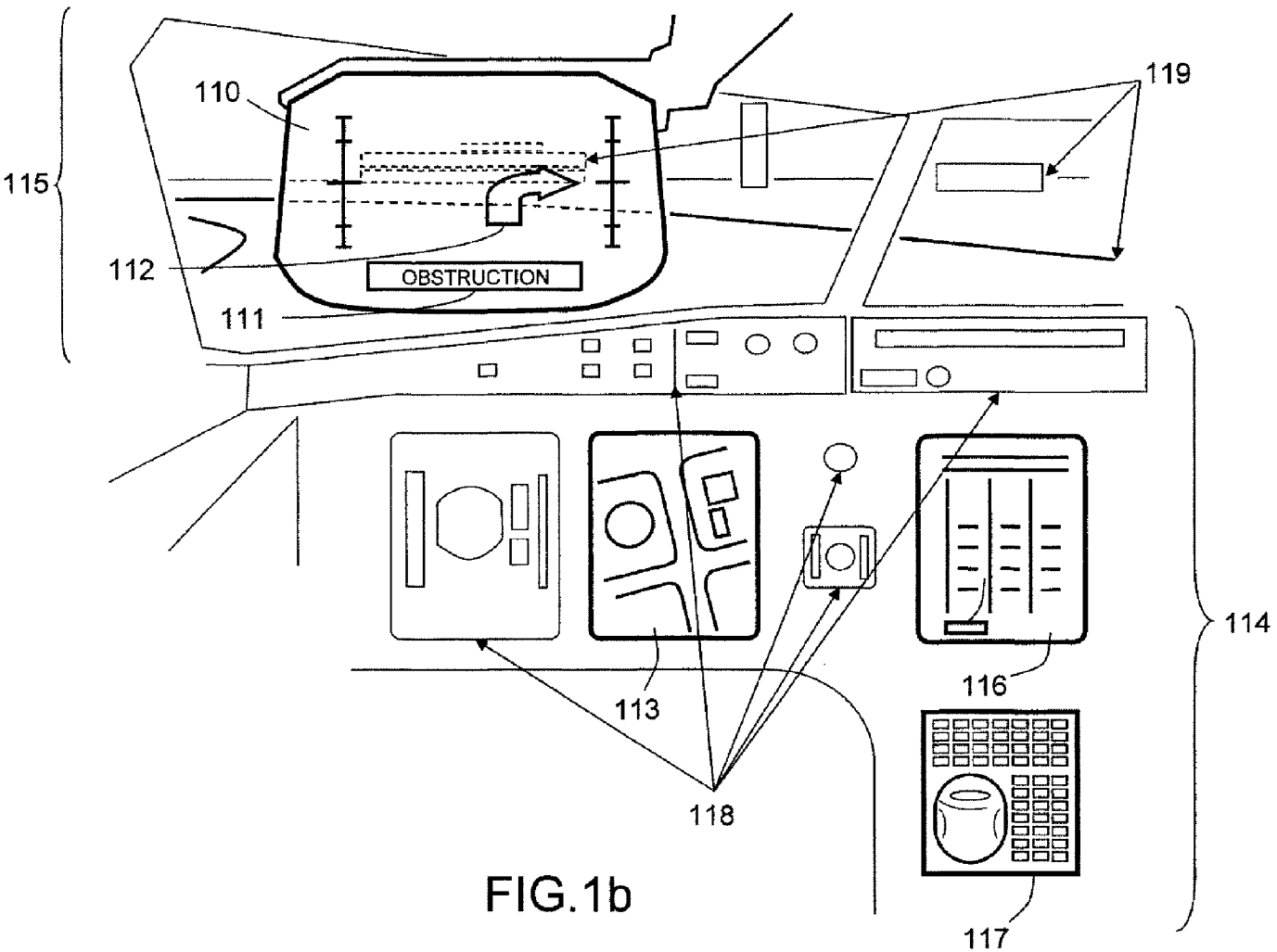
FIG. 1*b*: an exemplary configuration of various devices serving as interface between a crew of an aircraft and the collision prevention device according to the invention.

FIGS. 1*a* and 1*b* show an exemplary embodiment of a collision prevention device 1 according to the invention. The collision prevention device 1 can be installed on board a vehicle and notably on an aircraft.

The collision prevention device 1 comprises a collision prevention computer 3. The collision prevention computer 3 allows risks of collision between the aircraft carrying the collision prevention device 1 according to the invention and other vehicles or infrastructures that may be on the runway to be detected when the aircraft is taxiing for example. The collision prevention computer 3 can also generate conflict resolution measures in order to remove the aircraft from a conflict situation, in other words a potentially dangerous situation for the aircraft. The collision prevention computer 3 implements a collision prevention method whose various steps are described in more detail hereinbelow.

The collision prevention device 1 can comprise a detection data management system 2. The detection data management system 2 is notably responsible for collecting a set of detection data received from an assembly of active sensors. The sensors 100, 101, 102, 103 can for example be radar systems, cameras, etc. For example, the detection data management system 2 can therefore be connected to several radar systems R1, R2, R3, R4. In FIG. 1, the detection data management system 2 is connected to four radar systems R1, R2, R3, R4. The collision prevention device 1 notably collects the detection data supplied by the radar systems R1, R2, R3, R4 for example in the form of tracks. A track provides information on positioning of a target detected by a radar system, the position being associated with a velocity vector of the target. The velocity vector of the target gives an estimation of the direction of travel of the target and of its speed. All of these tracks are delivered to the collision prevention computer 3 in the form of a set of relative bearings of the targets with respect to the position of the radar systems R1, R2, R3, R4.

The collision prevention device 1 can comprise a traffic computer 4 collecting information received from an assembly of sources of air traffic and ground traffic data. These sources of traffic data are systems remote from the vehicle carrying the collision prevention device 1. This traffic data notably originates from the TCAS 5, TIS-B 6 and ADS-B 7 systems, and the traffic information can then come from either other vehicles or from a ground station. This information notably comprises the position of the various vehicles present on an airport surface. This information is made available to the collision prevention computer 3.

The collision prevention device 1 can comprise a mapping database 8. The mapping database 8 can map the topography of an airport for example, in which case it is an airport mapping database 8. The airport mapping database 8 provides information on the positions of various airport infrastructures. The positions of the airport infrastructures can for example be displayed or used in order to identify obstacles. The airport infrastructures can notably be hangers, airport terminals, buildings, runways, aprons or taxiways. This airport database can be of the type denoted by the acronym AMDB. This type of airport database is for example described in the ARINC-816 standard. The airport mapping database 8 can be accessible by the collision prevention computer 3 via a remote server. The airport mapping database 8 may also be part of the collision prevention device 1.

Another vehicle configuration database 9 provides information on characteristics, notably geometrical, of vehicles that may be found at an airport for example. This vehicle configuration database 9 can be interrogatable by the collision prevention computer 3. The vehicle configuration database 9 may also form part of the collision prevention device 1. The vehicle configuration database 9 notably comprises the configuration of the vehicle equipped with the collision prevention device 1. The configuration of a vehicle can, for example, be a numerical value representing the radius of a circle characterizing, for example, the space occupied by the vehicle as a function notably of its length and of its width. Other types of descriptions of a configuration of a vehicle are possible, such as a representation of the vehicle in three dimensions. The configuration database can also contain safety distances chosen as a function of characteristics of the vehicle. The safety distances can for example be specified by a manufacturer of the vehicle or else by a company using the vehicle such as an airline.

Localization devices 10 usually installed on board a vehicle, such as a GPS, acronym for Global Positioning System, or an IRS, acronym for Inertial Reference System, can form part of the collision prevention device 1. The localization devices 10 allow the collision prevention computer 3 to be aware of the current position, of the current speed and of the current acceleration of the vehicle equipped with the collision prevention device 1. The position, the speed and the acceleration can form part of localization data for the vehicle. Since the collision prevention device 1 according to the invention is mainly designed to be used during the taxiing phases of the vehicle, and notably of aircraft, the localization devices 10 can be configured to have an operation adapted to a taxiing phase.

A braking and steering system 11 dedicated to the direction control of the equipped vehicle can also form part of the collision prevention device 1. The braking and steering system 11 is notably used to guide the equipped vehicle. The braking and steering system 11 can be used by the collision prevention device 1 in order to implement conflict resolution measures, calculated by the collision prevention computer 3, with a view to avoiding a collision with an obstacle. The conflict resolution measures can be avoidance maneuvers or else braking maneuvers.

The collision prevention device 1 can also comprise a man-machine interface 12 allowing a driver of the vehicle or a crew of the aircraft to notably see information displayed relating to conflicts detected by the collision prevention computer 3.

An example of various devices providing the interface between a crew of an aircraft, for example, and the collision prevention device 1 is shown in FIG. 1*b*. The devices forming the interface between the crew and the collision prevention device 1 are notably located in the cockpit of the aircraft. The man-machine interface 12 can comprise a screen on which information for the crew is displayed. The screen can be replaced by a head-up display device 110 offering a collimated projection onto a windscreen 115 of the aircraft of the information to be displayed. Information, such as the presence of an obstruction 111, is presented for example in transparency mode on the windscreen 115 of the aircraft by the head-up display device 110. Airport infrastructures 119 are furthermore always visible through the windscreen 115. An arrow 112 can for example indicate the obstruction detected 111. Devices of the ND 113 and HUD 110 type, i.e. Navigational Display and Head Up Display, can be used to display the information relating to conflicts. An ND device 113 notably allows navigation information to be displayed. The ND device 113 can form part of a flight instrument panel 114 in the cockpit of the aircraft, the flight instrument panel 114 also comprising other navigational instruments 118. The HUD device 110 is a head-up display device 110 such as previously described.

The man-machine interface 12 can also allow the driver of the vehicle to modify parameters to be taken into account by the collision prevention computer 3, for example. These parameters are notably safety margins for the aircraft or else safety distances. The parameters can be modified by means of devices of the MFD 116 and KCCU 117 type, or Multi-Function Display and Keyboard and Cursor Control Unit. An MFD 116 associated with a KCCU 117 allows a member of the crew to have access to functions for modification of the parameters. The KCCU 117 allows, for example, the selection of parameters to be modified and new values of these parameters to be input. The MFD 116 notably provides the display of the parameters to be modified, together with the values input during the modification of these parameters.

Figure 2A:
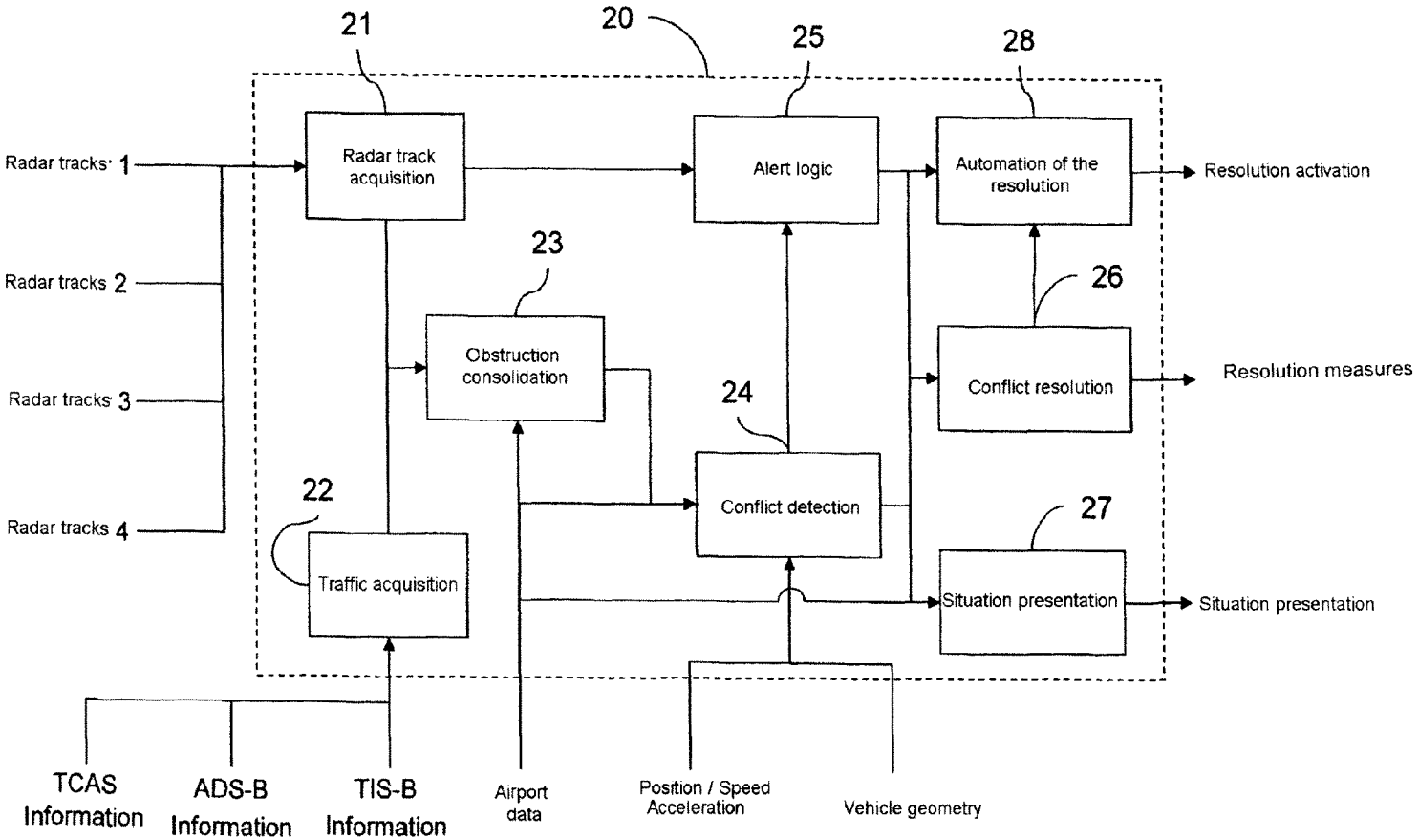
FIG. 2*a*: a flow diagram of various possible steps of a collision prevention method according to the invention.

FIG. 2*a* shows several possible steps in the collision prevention method 20 according to the invention.

A first step 21 is for example an acquisition step 21 for the detection of information, for example, originating from the sensors R1, R2, R3, R4. The detection information consists for example of tracks coming from at least one radar such as the radar tracks 1, radar tracks 2, radar tracks 3, radar tracks 4, for example. The number of sensors generating radar tracks is not limited. The detection information can be received in the form of a result of acquisition by a sensor or else in the form of targets generated by the sensor using acquisition results. A target can be defined by an azimuth angle, a distance between the target and the sensor, an elevation angle with respect to the ground, dimensions in distance or in angular opening, a speed value and a direction of travel. The sensor can identify the target as a function notably of the surface equivalent radar, or SER, of the target or of the type echo received. This identification information is then taken into account by the detection data management system 2.

A second step for acquisition of the traffic 22 can allow traffic information transmitted by collaborating systems such as the TCAS 5, the TIS-B 6 or the ADS-B 7 to be obtained. The traffic information can originate from ground stations or from carriers equipped with collaborating systems. For example, the traffic information can include:

- information transmitted by the aircraft via the ADS-B,
- information on localization of the vehicles transmitted by means of the TCAS,
- information on position of the objects and of the mobile units transmitted by a ground station by means of TIS-B systems, these positions being notably obtained by radar surveillance means of the ground air traffic control.

The traffic information transmitted notably comprise a position, which can be expressed in latitude, longitude, or in Cartesian coordinates by an abscissa and an ordinate. The elevation angle, the dimensions and a type of vehicle, together with a speed value and a direction of travel may also be transmitted by the collaborating systems.

The method according to the invention can comprise one or other, or else both, of the following steps: first step for acquisition of radar tracks 21 and second step for acquisition of the traffic 22. This allows the cases to be handled where either the information coming from the detection data management system 2 or the information coming from the traffic computer 4 is unavailable.

A third step 23 is a step for the implementation of a process for consolidation of the obstructions 23. An obstruction is a fixed obstacle or a mobile obstacle potentially putting in danger of collision the vehicle equipped with the collision prevention device 1. The traffic information and the detection information are correlated so as to obtain the most reliable information possible on the obstructions, such as their position and their speed, together with all the other information available. In the case where the traffic information is unavailable, the obstruction consolidation process mainly takes into account detection information. Similarly, if the detection information is not available, the step for consolidation of the obstructions 23 mainly takes into account traffic information. The obstruction consolidation process, implemented during the obstruction consolidation step 23, can also take into account airport data coming from the airport mapping database 8. The airport data notably comprises information on positioning of the fixed infrastructures of the airport, together with a map of the runways, taxiways and aprons, for example. This airport map notably allows obstructions to be identified as being airport infrastructures and therefore their dimensions and positions to be specified.

The obstruction consolidation step 23 therefore allows information output from various sources to be correlated, when these are available:

- the detection information output from the detection information acquisition step 21, given in a reference frame having the vehicle equipped with the collision prevention device 1 as reference point;
- the traffic information output from the traffic acquisition step 22. This information may be given in a reference frame other than the reference frame of the vehicle equipped with the collision prevention device 1, such as a geodesic reference frame for the positions;
- the airport mapping information given by the airport map;

During the obstruction consolidation step 23, a list of obstructions is notably constructed that comprises mobile obstacles and fixed obstacles simultaneously detected by a detection system comprising the radar tracks R1, R2, R3, R4 and by the radar surveillance means of the air traffic control. Each mobile obstacle or fixed obstacle from the list is characterized by all or some of the following information:

- position;
- height;
- vertical dimension;

value of the speed;
direction of travel;
relative bearing;
inter-distance between the obstruction and the vehicle;
variation of the inter-distance between the obstruction and the vehicle.

The relative bearing is a relative heading between the equipped vehicle and an obstruction. For each radar, a position of the obstruction along a direction, given by the relative bearing and the inter-distance between the obstruction and the vehicle, is therefore obtained. This information is then projected into an absolute reference frame.

The absolute value of the time variation of the inter-distance between the carrier and the obstruction is taken into account, in other words considered as non-zero, when it exceeds a settable threshold over a lapse of time fixed, for example, at a few seconds.

With each of the pieces of information characterizing an obstruction are associated:

a percentage of uncertainty in a measurement carried out in order to obtain the information, and
a degree of integrity of the measurement.

For example, a percentage of uncertainty in the value of the measured speed and a degree of integrity for the value of the measured speed are associated with the measured speed.

In order to obtain, for each type of information such as the position or the speed, an overall analysis of the values obtained notably during the step for acquisition of the radar tracks 21 and during the step for acquisition of the traffic 22, a weighted sum of each of the various values obtained can be performed.

This weighted sum uses for example a weighting criterion C normalised between zero and one, an example of calculation of the criterion C being detailed hereinbelow. The weighted sum can take the following form:

$$P_{MIX}=C\times P_1+(1-C)\times P_2 \tag{200}$$

where $P_{MIX}$ is a value resulting from a combination of the value $P_1$ output from the radar track acquisition step 21 and of a value $P_2$ output from the traffic acquisition step 22.

$P_{MIX}$ can for example be the position resulting from the weighted sum of the position $P_1$ output from the radar track acquisition step 21 and of the position $P_2$ output from the traffic acquisition step 22 for a given obstruction. The same operation can be carried out for the other information such as the speed and the direction of travel, for example, for each obstruction detected. The information $P_1$ and $P_2$ can be initially projected into one and the same reference frame which may, for example, be the reference frame of the carrier.

The criterion C can be calculated in the following manner:

$$C=\left[\left(\left(\prod_{i=1}^{n}(1+C_i)^{\alpha_i}\right)^{\frac{1}{\sum_{i)1}^{n}\alpha_i}}\right)-1\right] \tag{201}$$

C is therefore a percentage from a law for combining a number n of different parameters $C_i$, i being in the range between 1 and n. C is therefore a weighting criterion allowing a normalized importance criterion between zero and one of the various parameters $C_i$ to be defined. Each parameter $C_i$ is normalized, in other words is in the range between zero and one. A degree of importance $\alpha_i$ is associated with each parameter $C_i$. Each degree of importance $\alpha_i$ is settable and may be chosen depending on the relative importance that it is desired to assign to each parameter $C_i$ with respect to the other parameters $C_i$. n degrees of importance $\alpha_i$, whose values are in the range between zero and one and whose sum is equal to one, are therefore determined.

The number of parameters $C_i$ can, for example, be four: $C_1$, $C_2$, $C_3$, $C_4$, the parameter $C_1$ being for example the most important parameter and the parameter $C_4$ being the least important parameter, $C_2$ being more important than $C_3$.

A first parameter $C_1$ can for example be a distance measured directly between the carrier of the device 1 according to the invention and the obstruction detected. The distance measured directly can be output from the detection data management system 2, for example. The measurements coming from the detection data management system 2 are then increasingly favoured, for example as the detected comes closer to the carrier. An example of definition of the first parameter $C_1$ is notably shown in FIG. 2*b*.

Figure 2B:
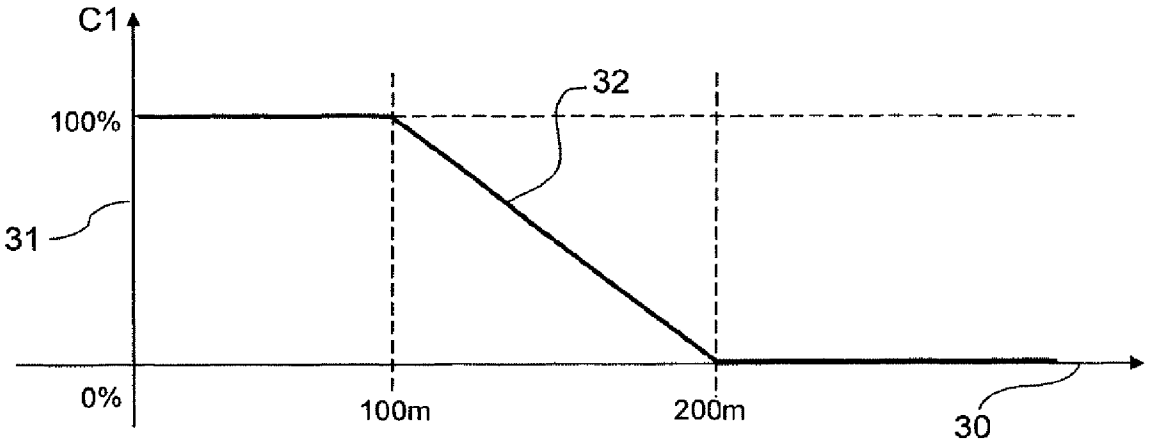
FIG. 2*b*: an example of nomogram for weighting of a criterion for determination of a proximity between two vehicles.

In FIG. 2*b*, the first parameter $C_1$ is for example defined in the form of a nomogram. The distance between the carrier and the obstruction is represented on an abscissa axis 30, an ordinate axis 31 representing a value of the first parameter $C_1$ expressed in percentage. A curve 32 represents the variation of the value of the first parameter $C_1$ as a function of the variation in the distance between the carrier and the obstruction. In the example shown in FIG. 2*b*, the first parameter $C_1$ is for example equal to 100% starting from a distance zero between the carrier and the obstruction, up to a distance of one hundred meters. Then, the value of the first parameter $C_1$ decreases, for example in a linear fashion, from 100% to 0%, the value 0% being for example reached for a distance of around two hundred meters between the carrier and the obstruction. Subsequently, for distances between the carrier and the obstruction greater than two hundred meters, for example, the value of the first parameter $C_1$ is for example equal to 0%.

A second parameter $C_2$ can be a speed of approach between the carrier and the obstruction if it is mobile. This speed can be expressed by a projection onto the axis of travel of the carrier. The parameter $C_2$ is for example normalized and can be defined by means of a nomogram such as that shown in FIG. 2*b*. $C_2$ can be expressed in percentage. For example, $C_2$ is equal to:

0% when the speed of approach is less than five knots, which means that one of the two vehicles is either stopped or almost stopped.
100% when the speed of approach is greater than fifteen knots, which means that the two vehicles are travelling at standard speeds.

$C_2$ then increases linearly, for example, between 0% and 100% for values of speed of approach that are in the range between five and fifteen knots. The speeds of approach between two vehicles varies typically between zero and a hundred knots, for example. The threshold and base values, for example five and fifteen knots, of the speed of approach can be settable.

A third parameter $C_3$ can be a distance between the vehicle and the obstruction detected, measured on the elements of the airport, over which the vehicle and, potentially, the obstruction travel. This distance is generally in the range between zero and three hundred meters. The elements of the airport can for example be a runway, an apron or a taxiway. The parameter $C_3$ can also be defined in the form of a percentage by a nomogram such as that shown in FIG. 2*b*. $C_3$ can then be equal to 0% when the distance is greater than a hundred and twenty meters, the vehicle then being at a standard distance from the obstruction. $C_3$ can be equal to 100% when the distance is less than sixty meters, for example. The value of $C_3$ can then vary linearly as a function of the distance for values of the latter in the range between sixty and a hundred and twenty meters. The threshold and base values of a hundred and twenty meters and of sixty meters can be settable.

A fourth parameter $C_4$ can be a time period calculated by adding the time before the passage of the equipped vehicle at a point of approach corresponding to a moment where the equipped vehicle and the obstruction are the closest, and a settable minimum time. The settable minimum time can be in the range between zero and thirty seconds, for example.

The fourth parameter $C_4$ can be defined by means of a nomogram such as that shown in FIG. 2*b*. $C_4$ can therefore be equal to 0% for time periods greater than thirty seconds, then 100% for time periods less than seven seconds. The value of $C_4$ can vary linearly for a time period in the range between thirty and seven seconds. The threshold and base values of thirty seconds and seven seconds can be settable.

Figure 2C:
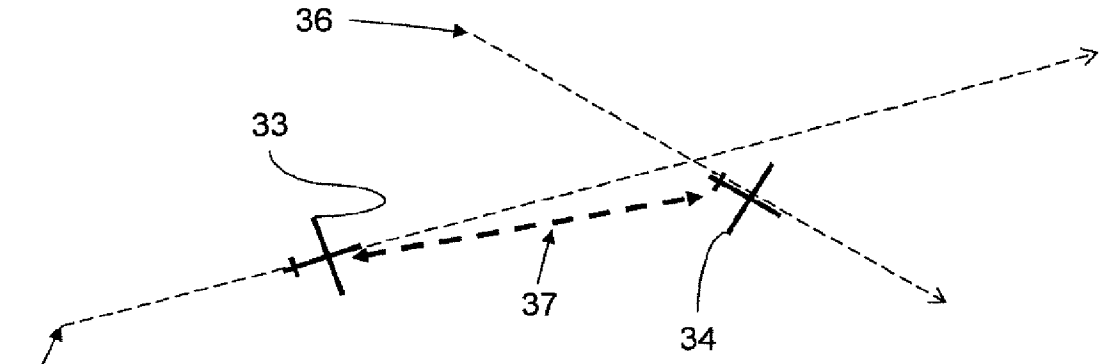
FIG. 2*c*: an example of proximity between two aircraft.

FIG. 2*c* gives an example of a point of approach between two aircraft 33, 34. The two aircraft 33, 34 each respectively follow a different flight path 35, 36. The first flight path 35 comprises at least one intersection with the second flight path 36. The point of approach is a point on the first flight path 35 corresponding to a moment where the two aircraft 33, 34 are at a minimum distance 37 taking into account their motion over their respective flight paths 35, 36. The calculation of this point of approach is well known to those skilled in the art.

The obstruction consolidation step 23 can therefore advantageously supply information on the obstructions consolidated by various sources of data. This allows very accurate localization information to be made available.

A fourth step 24 is a step for detection of conflict situations 24. The conflict situation detection step 24 implements a procedure for conflict detection. The objective of a conflict detection procedure is notably to determine situations of future proximity between the equipped vehicle and an obstruction. These situations of proximity between the equipped vehicle and an obstruction may potentially put the equipped vehicle and the obstruction in danger of collision. These situations of proximity are also referred to as conflict situations.

The conflict detection procedure takes into account the information relating to the consolidated obstructions, together with the airport data, the dimensions and geometry of the equipped vehicle and also its current position, its current speed and its current acceleration.

The information relating to the consolidated obstructions notably allow a proximity distance to be calculated between the equipped vehicle and each obstruction detected. The information relating to the consolidated obstructions also allows a speed of approach between the equipped vehicle and each obstruction to be calculated.

The dimensions and the geometry of the equipped vehicle allow a shape to be defined for the vehicle. The shape of the equipped vehicle is notably used in order to define a safety envelope around the equipped vehicle.

The topography of the airport included in the airport data allows, for example, the connectivity of the taxiways, aprons or runways to be verified in order to avoid proximity alarms being generated when the equipped vehicle and another vehicle are moving over topographical elements with no possible intersection.

The main objective of the conflict detection procedure is to determine a level of danger associated with a conflict detected. The level of danger is determined by using for example three phases.

A first phase of the procedure for conflict detection can be the generation of one or more safety envelopes around the equipped vehicle. A safety envelope takes into account safety margins around the vehicle. The safety margins are distances allowing one or more safety envelopes to be constructed as a function of geometrical characteristics of an equipped vehicle and of the movement of the equipped vehicle. The safety margins are for example settable by means of the man-machine interface 12. The safety margins can notably be stored in the vehicle configuration database 9. The safety margins can be of the order of thirty to one hundred and twenty meters, for example. The safety envelopes are for example protection volumes around the equipped vehicle. The penetration of a safety envelope by an obstruction causes the driver of the equipped vehicle to be warned of a risk of damage to the equipped vehicle.

Figure 3B:
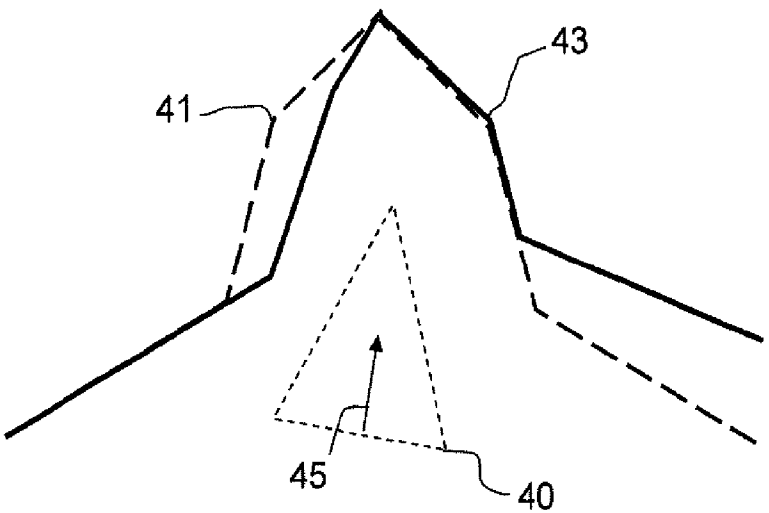
FIG. 3*b*: an example of modification of a safety envelope calculated for a right turn.
Figure 3A:
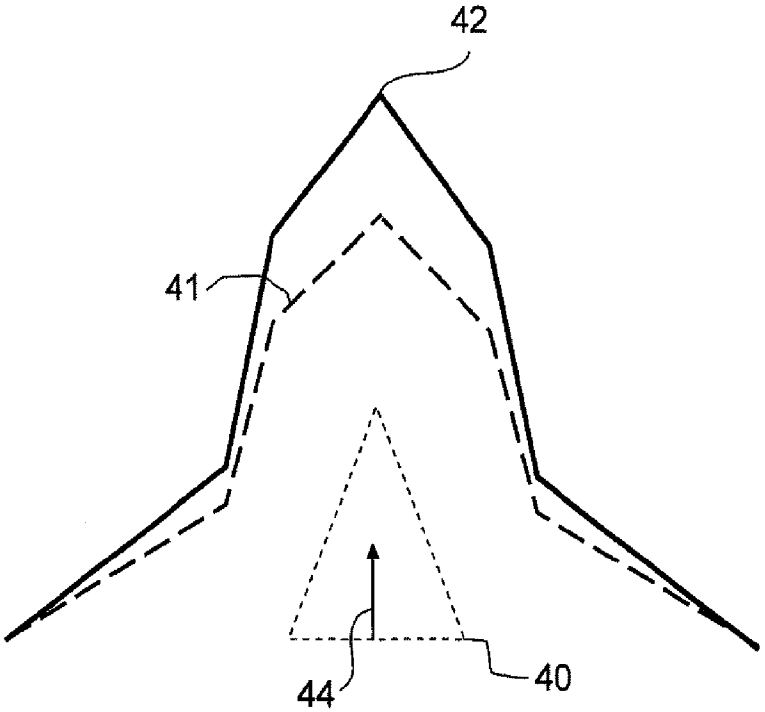
FIG. 3*a*: an example of modification of a safety envelope calculated for an increase in the speed of an aircraft.

FIGS. 3*a* and 3*b* show exemplary constructions of a safety envelope around an equipped vehicle 40. The safety envelopes 41, 42, 43 are notably determined as a function of the shape of the equipped vehicle 40 and of motion parameters of the equipped vehicle 40 such as its speed, its acceleration and its direction 44, 45. The movement parameters of the equipped vehicle 40 come notably from the localization devices 10 of the equipped vehicle 40.

Depending on the movement parameters of the equipped vehicle 40, the safety envelope is adapted in such a manner as to guarantee a sufficient level of safety of the equipped vehicle 40. The adaptations made on the safety envelope depend notably on the geometry of the equipped vehicle 40 and are therefore adapted to each vehicle type.

For example, in FIG. 3*a*, an adaptation of the initial safety envelope 41 is carried out in order to take into account an increase in the speed of the equipped vehicle 40. The volume of the initial safety envelope 41 is then increased and its shape extended along an axis 44 of travel of the equipped vehicle 40. The deformation of the initial envelope 41 gives a new envelope 42. The deformation of the initial envelope 41 is calculated, in this case, as a function of the increase in the speed of the equipped vehicle 40.

Another example shown in FIG. 3*b* exhibits a deformation of the initial envelope 41 in order to take into account a change in heading of the equipped vehicle 40. The other new envelope 43 is therefore deformed in such a manner as to favour a new direction of travel 45 of the equipped vehicle 40 at constant speed.

A second phase of the conflict detection procedure can be a verification of the penetration of the obstructions detected into the safety envelope or envelopes generated. A penetration by an obstruction can be detected by notably using the information on vehicle configuration stored in the vehicle configuration database 9, when the type of obstruction has been identified as being a known vehicle. This identification information on the type of obstruction can for example result from the traffic acquisition step 22 or else from the step for acquisition of radar tracks 23. Similarly, the airport map data can be used to provide information on the shape of the airport infrastructures if the latter correspond to an obstruction detected.

A third phase of the conflict detection procedure can for example be the evaluation of a period of time prior to penetration of the envelope by the obstruction. The time before penetration can be determined as a function of the speed of the equipped vehicle and of its direction of travel, for example. The time can also be determined as a function of a potential movement of the obstruction, if it is mobile. For example, the speed and also the direction of travel of the obstruction can be taken into account in order to determine a period of time remaining before penetration of the safety envelope by the obstruction. The time before penetration then allows a level of danger for the equipped vehicle 40 to be evaluated.

The conflict detection procedure can also calculate an inter-distance between the vehicle and an obstruction detected. This inter-distance is notably calculated between the obstruction and the element closest to the obstruction belonging to the geometry of the vehicle.

A fifth step 25 is a step implementing an alert logic. An alert logic notably allows a level of priority of an alert to be determined. An alert is for example triggered on detection of a conflict situation by the conflict detection procedure implemented during the step for detection of conflict conditions 24. The level of priority of an alert can for example depend on the time before penetration calculated during the third phase of the conflict detection procedure.

Several levels of priority may be defined. For example three levels of alert priority may be defined:

- A first level of alert can be a level called 'advisory'. An advisory level alert can be triggered for example when the time before penetration of the safety envelope by an obstruction is greater than about ten seconds for example. The advisory level can signify that the alert must capture the attention of the driver of the vehicle. In another embodiment, the first level of alert may be triggered when a distance between the vehicle and an obstruction is less than a first settable safety distance.
- A second level of alert, for example called 'caution', can be applied between ten and five seconds before the penetration of the safety envelope by the obstruction. The second level of alert requires, for example, an analysis of the conflict situation by the driver and a correction, where necessary, to the movement of the vehicle. The second level of alert may be applied, in another embodiment, when a distance between the vehicle and an obstruction is less than a second settable safety distance, less than the first safety distance.
- A third level of alert, that may be called 'warning', can require the instigation of at least one immediate action in order to correct the movement of the vehicle. The third level of alert can be triggered upon penetration of the safety envelope by an obstruction. The corrective actions on the travel path can be undertaken by the driver of the vehicle, for example, or by an automatic drive system for the vehicle. The third level of alert may, in another embodiment, be triggered when a distance between the vehicle and an obstruction is less than a third settable safety distance, for example less than the second safety distance.

A sixth step 26 is a conflict resolution step. A conflict resolution procedure is implemented during the conflict resolution step 26. The conflict resolution procedure notably determines the procedure to be applied in order to resolve a conflict situation, in other words remove the vehicle from a potential danger or certainty of collision with an obstruction.

Considering, for example, an aircraft taxiing at an airport, a procedure generated by the conflict resolution procedure is principally a braking instruction. Indeed, if the conditions of motion of the aircraft, its speed, its braking capacity and its maneuverability are considered, a braking operation is the means best adapted to removing the aircraft from a danger of collision. Other means may be envisaged in a more general case, such as an acceleration, a deceleration, a brake application or even a change of direction of the vehicle.

The conflict resolution procedure notably takes into account the results of the conflict detection procedure, the level of alert according to the alert logic 25, the movement parameters of the vehicle such as its speed and its acceleration, but also configuration data of the vehicle such as its mass and its maneuverability.

The conflict resolution procedure can for example implement several calculations:

- a first calculation is for example the generation of a speed for the vehicle, which could be zero, allowing the conflict to be resolved.
- a second calculation is the generation of an ad hoc braking or deceleration setting instruction notably taking into account: the braking or deceleration capacities of the vehicle, together with rules for comfort, ensuring the safety of the structure of the vehicle and also of any passengers in the vehicle.

The conflict resolution procedure can calculate an instruction, which can also be referred to as conflict resolution measure, as a function of the level of the alert supplied by the alert logic 25. For example, when the alert is an advisory level alert, the resolution measure will use a gentle braking capacity in order not to disturb the comfort of the passenger. When the level of alert is for example a warning level, the resolution measure can be a sharp brake application notably leading to the stopping of the vehicle.

In order to avoid a rapid succession of brake applications, the conflict resolution procedure can take into account the inter-distance between the vehicle and an obstruction detected. The inter-distance is calculated by the conflict detection procedure. A rapid succession of brake applications occurs notably when the inter-distance between the vehicle and the obstruction is equal to a first threshold corresponding to a time before collision triggering an alert. In order to overcome this drawback, one solution is to define a second threshold A of around two hundred meters for example, and to calculate a speed setting allowing a threshold B, of around two hundred and twenty meters for example, to be attained within a period of time C of around ten seconds for example.

The conflict resolution procedure can generate several types of resolution measures:

- a first solution, with a low rate of deceleration, can be a first speed to be applied and to be maintained in order to comply with the first safety distance between the vehicle and an obstruction detected;
- a second solution, with a moderate rate of deceleration, can be a second speed to be applied and to be maintained in order to comply with the second safety distance;
- a third solution, with high deceleration rate, can be a third speed to be applied immediately, the distance between the vehicle and an obstruction detected being less than the third safety distance.

Other types of conflict resolution procedure may be implemented depending on the type of vehicle involved in the conflict detected.

A seventh step 27 can be a step for presentation of the situation. The presentation of the situation can be effected thanks to the man-machine interface 12. The information displayed can notably be:

- the vehicle equipped with the collision prevention device 1 positioned on a map showing the various airport elements such as described in the airport mapping database 8, where the vehicle can for example be represented symbolically;
- various airport elements shown schematically;
- other vehicles located within the environment of the equipped vehicle, represented symbolically;
- less obstructions detected, which could include an indication of the origin of the detection such as for example the detection by radar tracks or by traffic acquisition;
- the safety envelope or envelopes calculated by the conflict detection procedure;

the conflicts between the equipped vehicle and the obstructions detected;

the inter-distances between the equipped vehicle and the obstructions detected, together with any time variation of the inter-distances;

the alert level of the conflict detected;

the conflict resolution measures envisaged in the form of setting instructions for deceleration or speed.

The resolution measures can be displayed in order that the crew of the aircraft, for example, implement the setting instructions given by the conflict resolution measures.

In the absence of penetration of the safety envelope by an obstruction, the man-machine interface 12 displays an envelope notably representing a region of detection of potential obstructions by the radar systems R1, R2, R3, R4, for example. The envelope is caused to deform and to approach the vehicle up to the point where an obstruction penetrates the safety envelope of the vehicle and generates an alert. The man-machine interface 12 then displays the penetration situation of the safety envelope together with the obstruction responsible for the penetration.

In a situation of penetration of the safety envelope by an obstruction, the man-machine interface 12 notably displays the region of penetration with the following information:

a symbolism representing the level of alert attained during the penetration, this symbolism can be a display colour for the obstruction associated with each level of alert, for example, and a particular type of outline such as a solid line;

an estimation of the inter-distance between the obstruction and the equipped vehicle, the inter-distance being calculated by the conflict detection procedure.

Examples of displays of various elements of the situation are shown in FIGS. 4*a* to 4*f*.

An eighth step 28 can be a step implementing an automation procedure for the resolution of a conflict detected. This step for automation of the resolution of a conflict is an optional step. The automation procedure takes into account conflict resolution measures such as a setpoint deceleration or speed coming from the conflict resolution procedure, together with an alert level calculated by the alert logic 25. The automation procedure is responsible for the conversion of the resolution measures into specific settings to be applied to each of the systems on the vehicle involved in a manoeuvre aiming to resolve the conflict detected. The automation procedure generates, for example, one or more setpoints intended for the braking and steering system 11 of the equipped vehicle.

The alert level can be taken into account by the automation procedure in the following manner: only an alert of the warning type may for example give rise to an automation of the application of a resolution measure. For the other alerts, the implemented of the resolution measures can be delegated to the driver of the equipped vehicle for example.

Figure 4A:
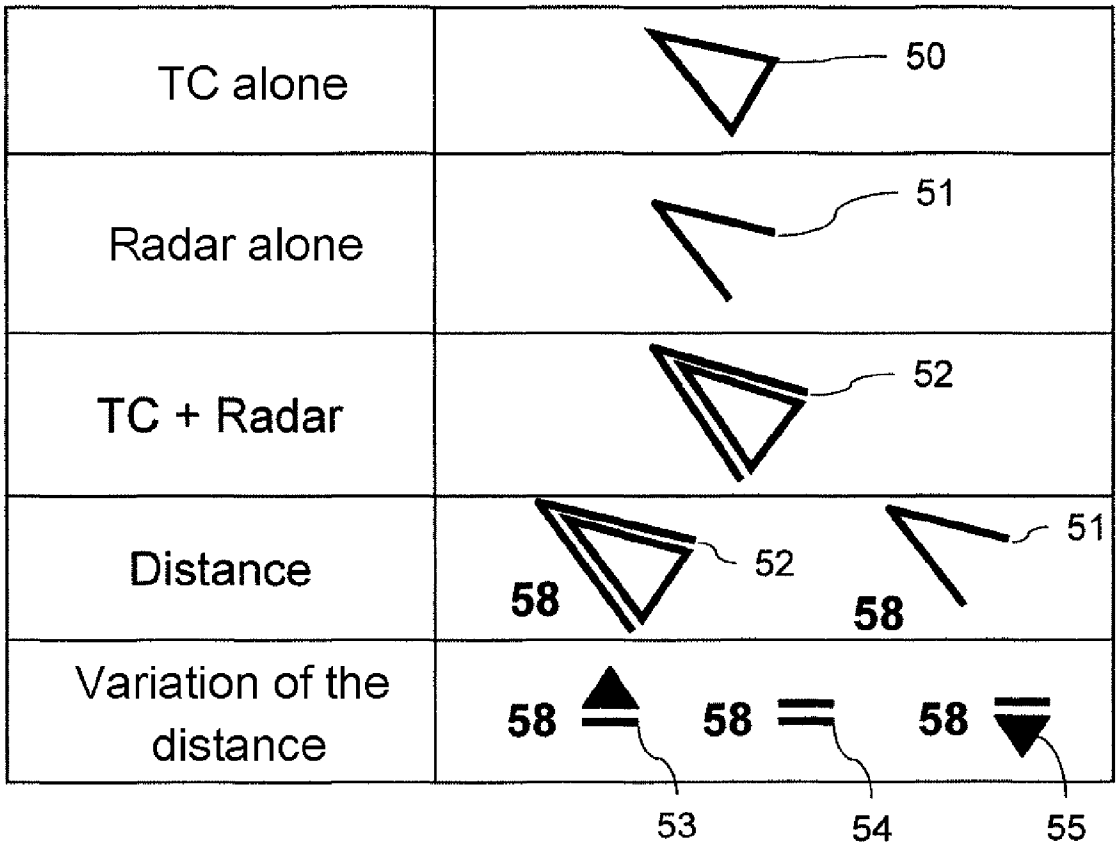
FIG. 4*a*: a table of examples of various symbols for representing various kinds of information relating to an obstacle.

FIG. 4*a* exhibits various types of symbols allowing an obstruction, together with information associated with the obstruction, to be displayed:

a first symbol 50 can represent an obstruction detected by the traffic computer 4 or TC alone;

a second symbol 51 can represent an obstruction detected by the radar means R1, R2, R3, R4 alone;

a third symbol 52 can represent an obstruction detected by the radar means R1, R2, R3, R4 and the traffic computer 4;

an inter-distance between the obstruction and the equipped vehicle, for example fifty-eight meters, can be associated with an obstruction symbol such as the third symbol 52 or the second symbol 51;

a fourth symbol 53 associated with a distance, for example fifty-eight meters, can allow an increase in the inter-distance between the equipped vehicle and an obstruction to be represented;

a fifth symbol 54 associated with a distance, for example fifty-eight meters, can allow a stagnation of the inter-distance between the equipped vehicle and an obstruction to be represented;

a sixth symbol 55 associated with a distance, for example fifty-eight meters, can allow a decrease in the inter-distance between the equipped vehicle and an obstruction to be represented.

FIGS. 4*b* to 4*f* show various situations. The representation of a situation notably comprises a cartographic representation of the surface 60 of an airport for example. A cartographic representation of the surface 60 of an airport can notably comprise a runway 61, one or more aprons 62, one or more taxiways 63 and one or more buildings 600.

In each FIG. 4*b*, 4*c*, 4*d*, 4*f*, an aircraft 64 equipped with a collision prevention device 1 is shown.

Figure 4B:
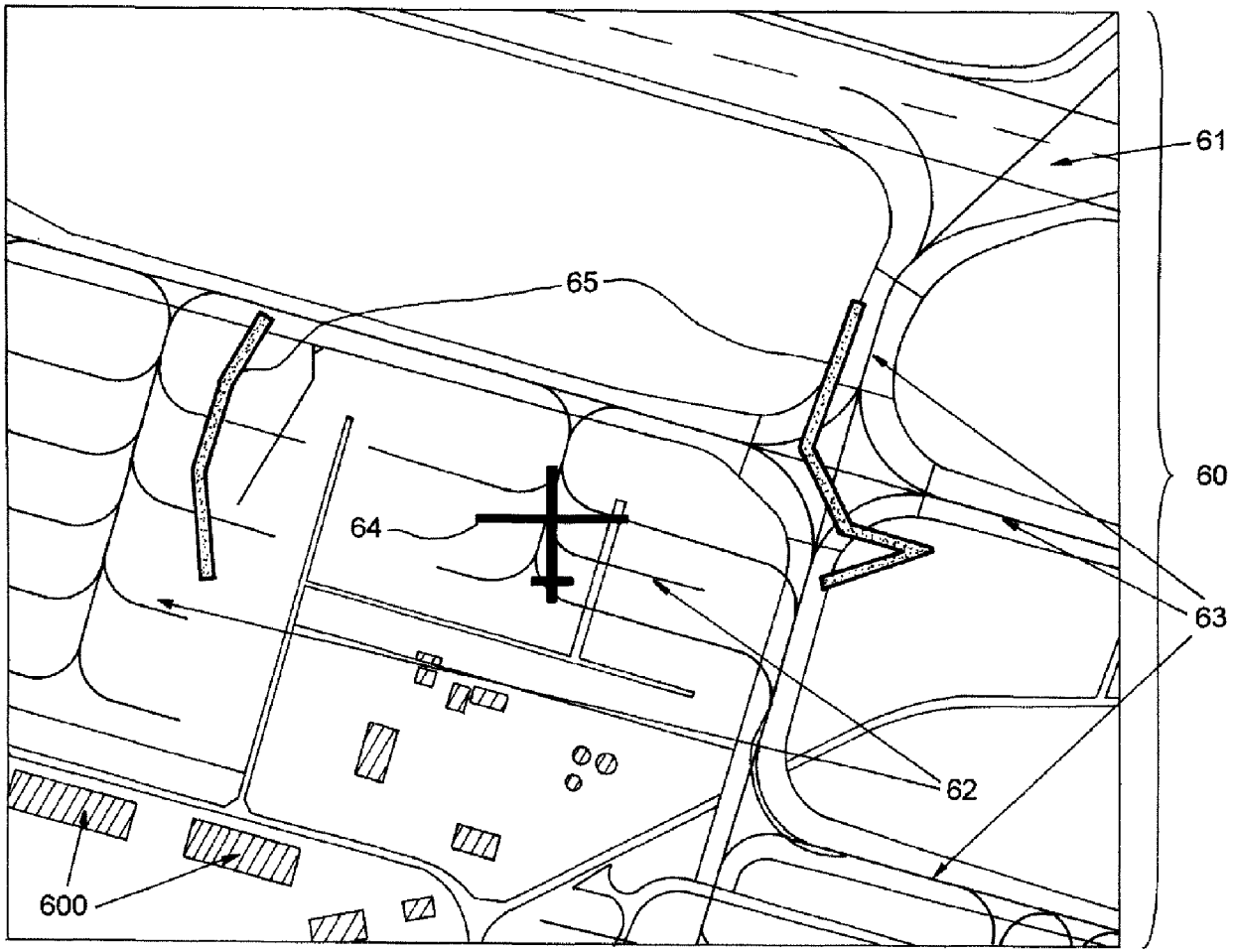
FIG. 4*b*: one possible display of a safety envelope with no nearby obstacle.

FIG. 4*b* shows various elements of a safety envelope 65 of the aircraft 64 with no nearby obstruction.

Figure 4C:
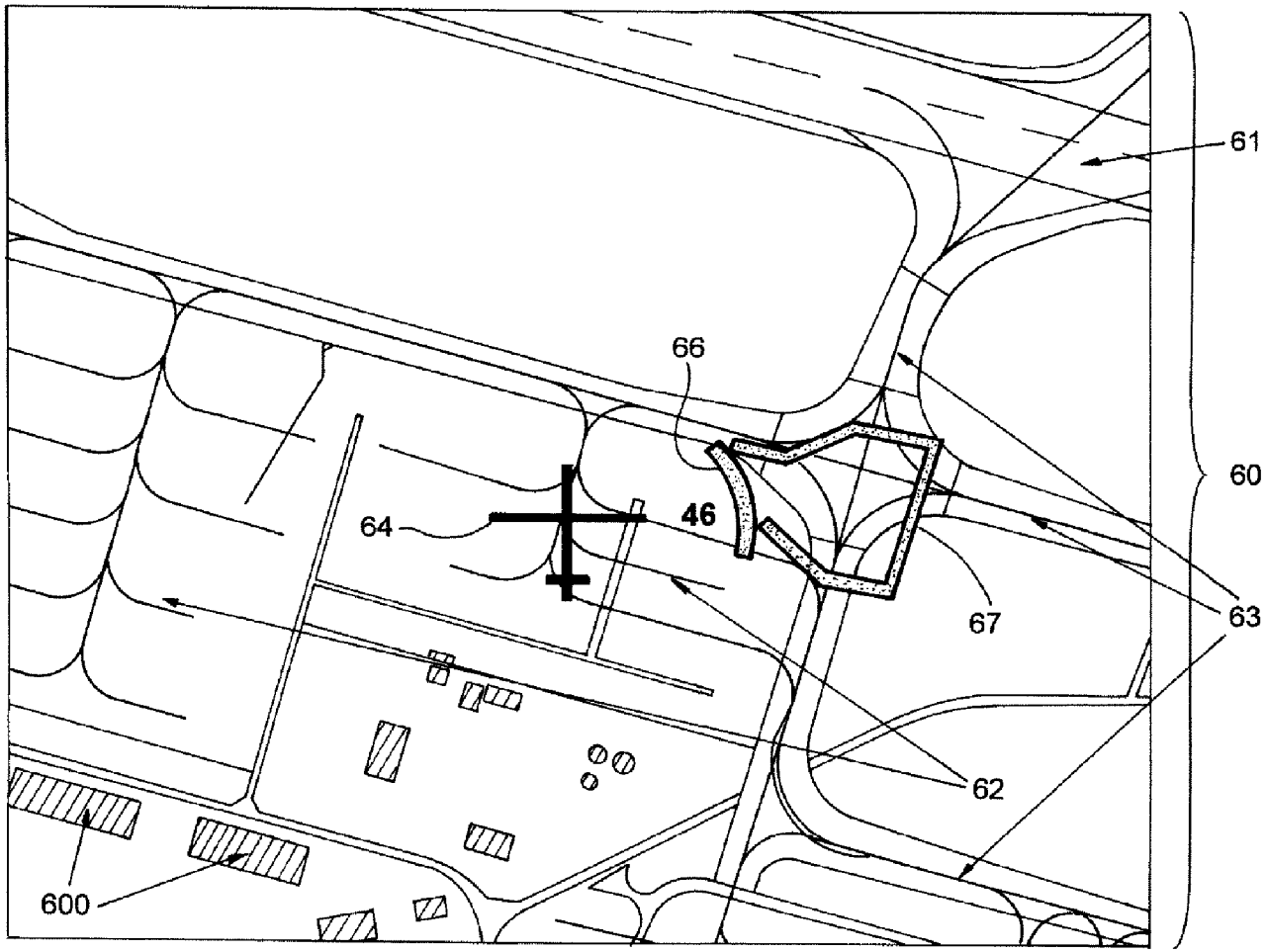
FIG. 4*c*: one possible display of a safety envelope with a nearby obstacle.

FIG. 4*c* shows a safety envelope 66 in the presence of an obstruction 67 that may give rise to a conflict generating an alert of the warning type for example. The elements 67 of the topography of the airport involved in the conflict here represent an intersection between several taxiways 63. An inter-distance of forty-six meters is also shown in FIG. 4*c* between the aircraft 64 and the obstruction 67.

Figure 4D:
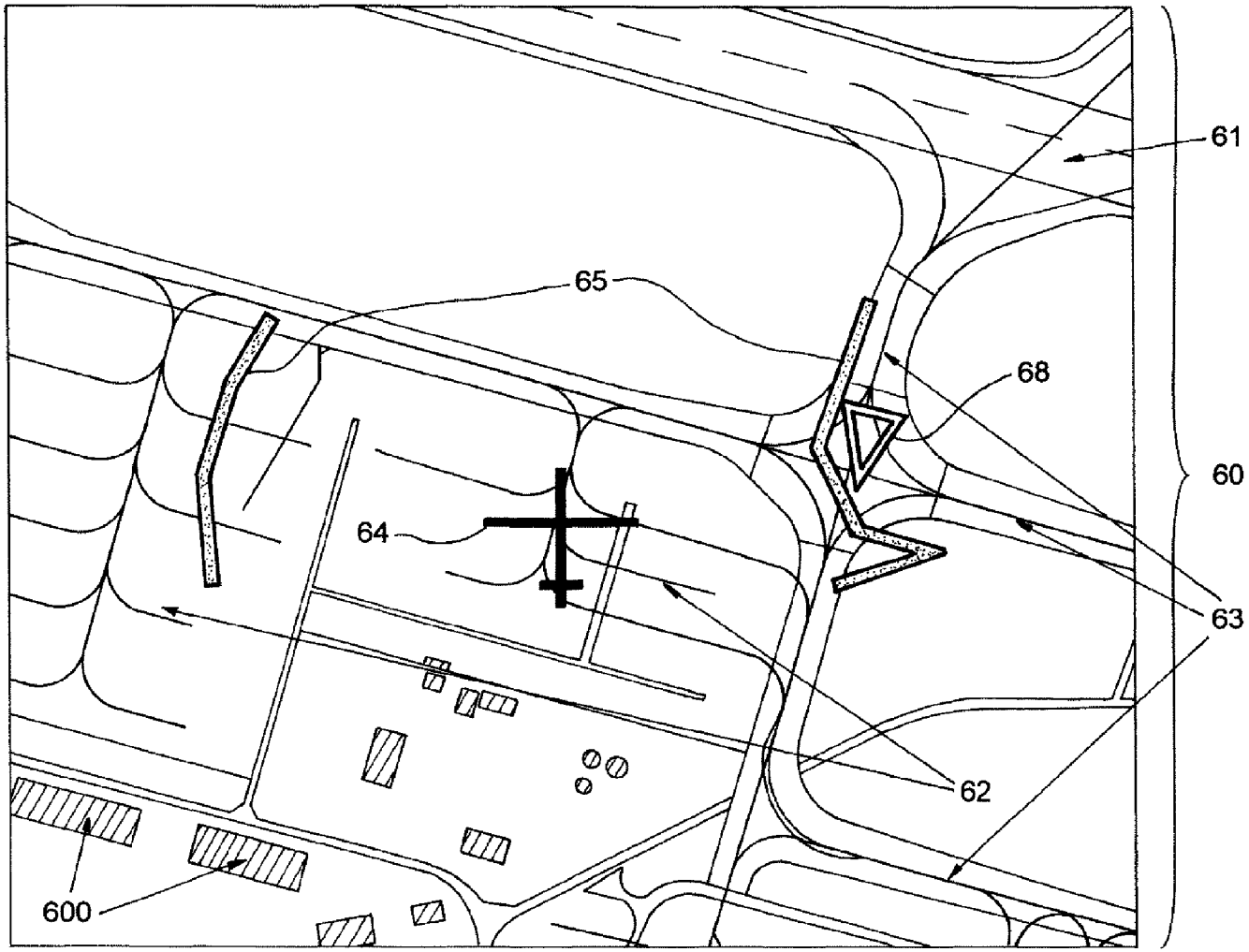
FIG. 4*d*: one possible display of a safety envelope with a remote obstacle.

FIG. 4*d* shows the various elements of the safety envelope 65 of the aircraft 64 in the presence of a mobile unit 68 detected by the traffic computer 4 alone. The mobile unit 68 does not present a threat of conflict with the aircraft 64, since it is situated outside of the safety envelope 65.

Figure 4E:
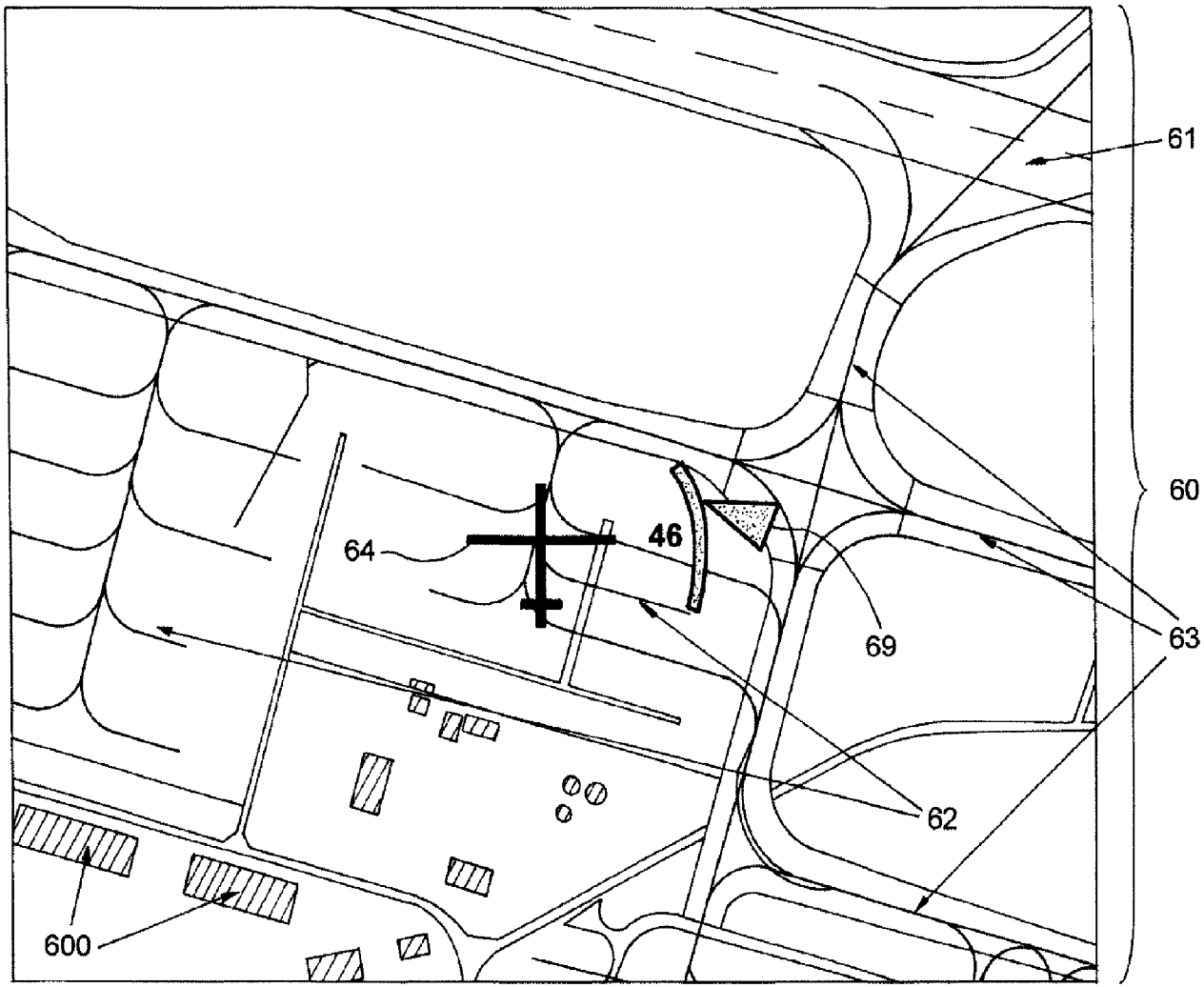
FIG. 4*e*: one possible display of a safety envelope with a nearby obstacle.

FIG. 4*e* shows a conflict situation giving rise to an alert of the warning type, for example in the presence of an obstruction 69 situated at a distance of forty-six meters for example from the aircraft 64. The obstruction 69 has been detected by the traffic computer 4 alone.

Figure 4F:
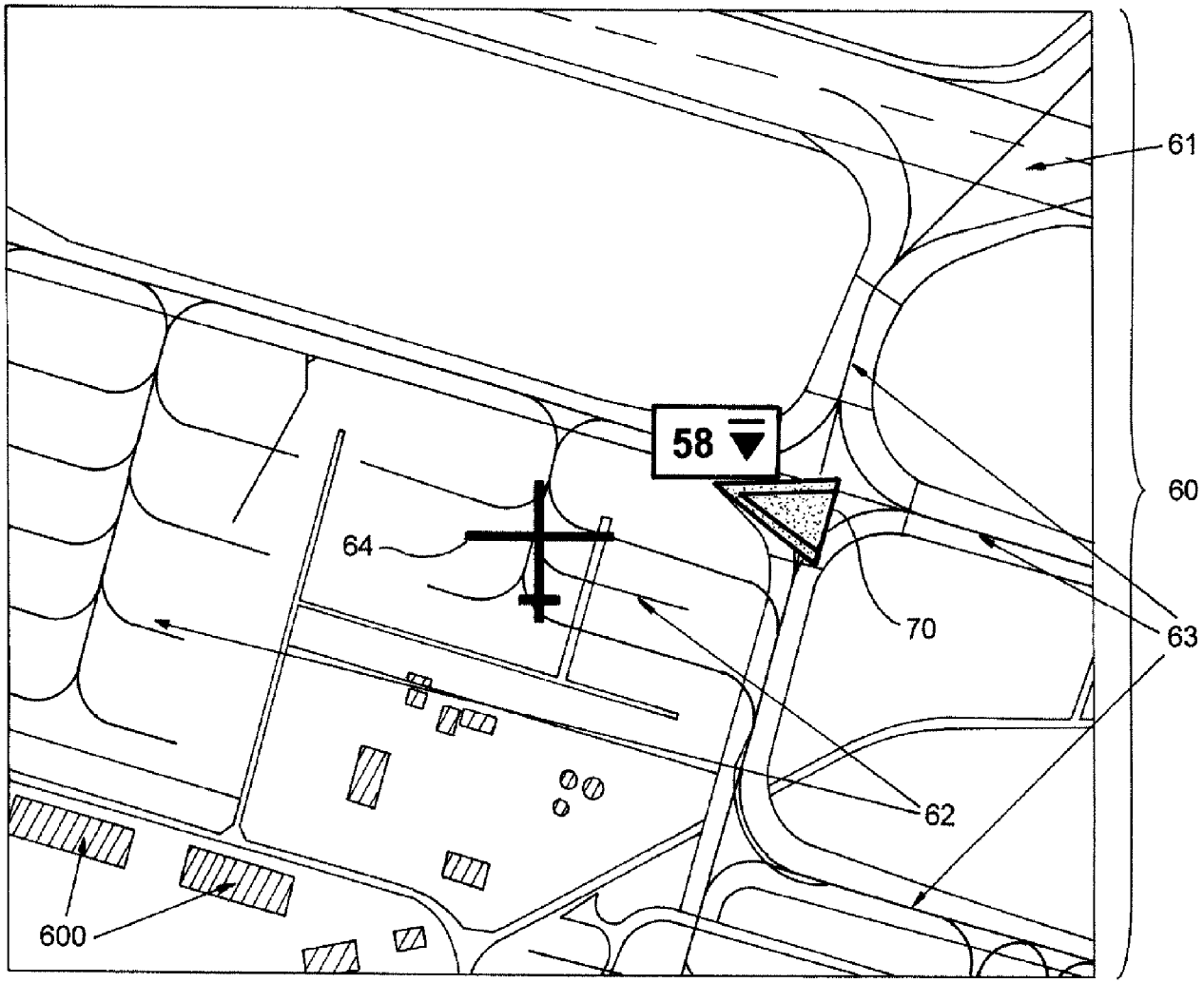
FIG. 4*f*: one example of display of various kinds of information relating to a mobile unit in conflict with an aircraft.

FIG. 4*f* shows a conflict situation in the presence of an obstruction 70 detected by the radar means R1, R2, R3, R4 and the traffic computer 4. The inter-distance between the aircraft 64 and the obstruction 70 is for example fifty-eight meters, and this inter-distance is decreasing.

The collision prevention device 1 advantageously allows the separation between a vehicle equipped with the said device and an obstruction to be maintained. Indeed, an alert of an advisory level can for example be used to keep a safety margin between the equipped vehicle and the obstruction responsible for the advisory level alert. As soon as an alert of the advisory type occurs, the ad hoc setting instructions for resolving the conflict relating to the advisory alert can allow the crew of the equipped vehicle, applying the setting instructions, to maintain a certain safety distance. These settings can for example be a speed to be maintained in order to keep the safety distance. The safety distance thus maintained is defined by inter-distance conditions between the equipped vehicle and the obstruction. The safety distance is therefore a function of the speed of approach between the equipped vehicle and the obstruction. The collision prevention device 1 thus allows a safety distance to be maintained between the equipped vehicle and the localized obstructions.

Advantageously, the collision prevention device 1 is applicable to various types of vehicles likely to be driven over a controlled surface of an airport. The various types of vehicles can for example be:

service vehicles such as pilot cars, fuel supply trucks, de-icing vehicles, safety vehicles, vehicles of runway management personnel, tractors and baggage carts;

civil or military passenger of freight transport aircraft;

pilotless aircraft, capable of being moved automatically under the control of automatic management systems for the moving of vehicles.

Advantageously, for the pilotless aircraft, the device according to the invention is particularly relevant. The reason for this is that since the two obstruction detection systems used by the device according to the invention are independent, they provide a sufficient level of integrity in order to replace the pilot, together with the obligation of a visual external surveillance as is currently imposed by the procedures in force.

Generally speaking, the device according to the invention advantageously obviates the need for equipment on the ground responsible for detecting non-collaborating elements, in other words elements not broadcasting their position for example.

Furthermore, the device according to the invention enables the consolidation of information coming from various processing chains: a radio processing chain for the acquisition of the traffic 22, a radar processing chain for the acquisition of the radar tracks 21, together with information coming from an airport mapping database 8. The independence of the processing chains advantageously enables a reliable detection of the obstructions. The reliability of the detection also allows functions for resolution of conflicts with the obstructions detected to be implemented and conflict resolution maneuvers, such as braking or a change of travel path, to be automated.

It will be readily seen by one of ordinary skill in the art that the present invention fulfils all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by definition contained in the appended claims and equivalents thereof.

The invention claimed is:

1. A collision prevention device for preventing collisions between a vehicle in motion on the ground, equipped with said collision prevention device, and obstacles, said device comprising:

a unit for localizing obstacles;

a unit for acquiring obstacle localization data;

a unit for localizing the equipped vehicle;

a collision prevention computer configured for:

consolidating the obstacle localization data from the unit for acquiring to output a weighted sum of the localization data for each of the obstacles localized;

taking into account a description of a configuration of the equipped vehicle and the localization of the equipped vehicle;

detecting proximity conflicts between the equipped vehicle and the localized obstacles based on the weighted sum of the localization data, the description of the configuration of the equipped vehicle and the localization of the equipped vehicle;

generating alerts in the case of proximity of the equipped vehicle and the localized obstacle, said alerts having various levels;

generating at least one conflict resolution guidance according to at least one of the determined levels for resolving each conflict detected; and a presentation unit for presenting warnings to a driver of the equipped vehicle.

2. Device according to claim 1, further comprising a mapping database configured for storing topographical data used in the collision prevention computer.

3. Device according to claim 1, wherein the unit for localizing the equipped vehicle is configured for providing localization and kinematics information on the equipped vehicle to the collision prevention computer.

4. Device according to claim 1, wherein the description of the configuration of the equipped vehicle is a space-occupation circle of the vehicle, and a size of the space-occupation circle is based on a length and a width of the vehicle.

5. Device according to claim 1, further comprising a vehicle configuration database configured for storing the description of the configuration of the equipped vehicle.

6. Device according to claim 1, further comprising a braking and steering system implementing said conflict resolution guidance.

7. Device according to claim 1, wherein said collision prevention computer is configured for generating said various levels of the alerts which include a first level of alert that warns the driver of the vehicle that a first safety distance between the vehicle and an obstacle has been breached.

8. Device according to claim 7, wherein said collision prevention computer is configured for generating said various levels of the alerts which further include a second level of alert warns the driver of the vehicle that a second safety distance, smaller than the first safety distance, between the vehicle and an obstacle has been breached.

9. Device according to claim 8, wherein said collision prevention computer is configured for generating said various levels of the alerts which further include a third level of alert warns the driver of the vehicle to trigger an immediate action for avoiding an obstacle, the distance between the vehicle and the obstacle being less than a third safety distance, less than the second safety distance.

10. Device according to claim 8, wherein said collision prevention computer is configured for generating said various levels of the alerts which include a third level of alert warns the driver of the vehicle that the conflict resolution guidance is implemented by a braking and steering system, the distance between the vehicle and an obstacle being less than a third safety distance, less than the second safety distance.

11. Device according to claim 1, wherein the collision prevention computer is configured for generating a first conflict resolution guidance, with a low deceleration rate, proposing a first speed to the driver of the vehicle to be applied and to be maintained in order to comply with a first safety distance between the vehicle and an obstacle.

12. Device according to claim 11, wherein the collision prevention computer is configured for further generating a second guidance, with an intermediate deceleration rate, proposing a second speed to the driver of the vehicle to be applied and to be maintained in order to comply with a second safety distance, less than the first safety distance, between the vehicle and an obstacle.

13. Device according to claim 12, wherein the collision prevention computer is configured for further generating a third guidance, with a high deceleration rate, proposing a third speed to the driver of the vehicle to be immediately applied in order to ensure avoidance of an obstacle, the distance between the vehicle and the obstacle being less than a third safety distance, less than the second safety distance.

14. Device according to claim 12, wherein the collision prevention computer is configured for generating a third guidance, with high deceleration rate, implemented by a braking and steering system, the distance between the vehicle and an obstacle being less than a third safety distance, less than the second safety distance.

15. Device according to claim 1, wherein said unit for acquiring obstacle localization data is a traffic computer carrying out a data acquisition for the localization and identification of the obstacles, the localization and identification data originating from systems remote from the equipped vehicle.

16. Device according to claim 1, wherein said unit for acquiring obstacle localization data is a detection data management system.

17. Device according to claim 16, wherein the detection data management system is configured to identify the obstacles detected.

18. Device according to claim 16, wherein the unit for localizing the equipped vehicle is radar.

19. Device according to claim 18, wherein the radar is distributed over the equipped vehicle.

20. Device according to claim 2, wherein the presentation unit is configured for displaying the obstacles, the proximity conflicts, the topographical data, the alerts, the conflict resolution guidance and a representation of the vehicle.

21. Device according to claim 16, wherein the presentation unit is configured for displaying an indication of the type of data having allowed the identification of the obstacle, the type of data being:

data coming from a detection data management system;

data coming from a traffic computer;

data coming from a management system for detection data combined with data coming from a traffic computer.

22. Device according to claim 1, wherein, the presentation unit is configured for displaying information on the inter-distance between the vehicle and an obstacle detected.

23. Device according to claim 1, wherein the presentation unit is configured for displaying information on the variation with time of the inter-distance between the vehicle and an obstacle.

24. Device according to claim 1, wherein the vehicle is an aircraft moving over an airport surface.

25. Device according to claim 1, wherein the aircraft is a pilotless aircraft.

26. Device according to claim 1, wherein a system remote from the vehicle is a TCAS, acronym for Traffic Collision Avoidance System.

27. Device according to claim 1, wherein a system remote from the vehicle is an ADS-B system, acronym for Automatic Dependant Surveillance Broadcast.

28. Device according to claim 1, wherein a system remote from the vehicle is a TIS-B system, acronym for Traffic Information Service Broadcast.

29. A collision prevention method for a vehicle in motion on the ground, said vehicle equipped with a collision prevention device, said method implemented by the collision prevention device and comprising at least the following steps:

acquiring obstacle localization data;

consolidating the obstacle localization data to output a weighted sum, calculated by the collision prevention device, of the localization data for each of the obstacles localized;

detecting, by the collision prevention device, conflicts between the localized obstacles and the vehicle based on the weighted sum of the localization data and a geometrical description of the vehicle;

generating alerts in the case of a conflict being detected, said alerts having various levels;

generating a conflict resolution guidance upon generation of at least one of the levels; and presenting warnings to a driver of the equipped vehicle.

30. Method according to claim 29, further comprising a step of acquiring identification information on the localized obstacles.

31. Method according to claim 29, wherein the conflict detection takes into account localization and kinematics information on the vehicle.

32. Method according to claim 29, comprising a step of automating conflict resolution guidance implementing a braking and steering system for the vehicle.

33. Method according to claim 29, further comprising a step of providing the localization data from a traffic computer.

34. Method according to claim 29, further comprising a step of providing the localization data from an obstacle detection data management system.

35. Method according to claim 34, further comprising a step of providing the obstacle detection data from at least one radar system positioned on the equipped vehicle.

36. Method according to claim 33, further comprising taking into account localization data by the traffic computer from the following systems:

TCAS, acronym for Traffic Collision Avoidance System;

ADS-B, acronym for Automatic Dependant Surveillance Broadcast;

TIS-B, acronym for Traffic Information Service Broadcast.

37. Method according to claim 29, wherein the conflict detection step takes into account topographical data stored in a mapping database.

38. Method according to claim 34, wherein a geometrical description of the vehicle is a space-occupation circle for the vehicle, a size of the space-occupation circle is based on a length and a width of the vehicle, and the space-occupation circle is stored in a configuration database for the vehicle.

39. Method according to claim 34, wherein the weighted sum of the localization data is provided from the traffic computer and the detection data management system.

40. Method according to claim 39, wherein the weighted sum is of the form:

$$P_{MIX}=C\times P_1+(1-C)\times P_2$$

where $P_{MIX}$ is a localization data value resulting from the weighted sum of a value $P_1$ of the localization data coming from the detection data management system and of a value $P_2$ of the localization data coming from the traffic computer, C being a weighting criterion.

41. Method according to claim 40, wherein the weighting criterion C is obtained according to the equation:

$$C=\left[\left(\left(\prod_{i=1}^{n}(1+C_i)^{\alpha_i}\right)^{\frac{1}{\sum_{i=1}^{n}\alpha_i}}\right)-1\right]$$

where C is a result of a law for mixing a number n of different parameters $C_i$, i being in the range between one and n, a settable degree of importance $\alpha_i$ being associated with each parameter $C_i$.

42. Method according to claim 41, wherein:

a first parameter $C_1$ is a distance measured between the equipped vehicle and a localized obstacle;

a second parameter $C_2$ is a speed of approach between the equipped vehicle and the localized obstacle;

a third parameter $C_3$ is a distance between the equipped vehicle and the localized obstacle, measured on elements of the airport, described by data on the topography over which the equipped vehicle is in motion.

43. Method according to claim 29, wherein the conflict detection step constructs at least one safety envelope as a function of: settable safety margins around the vehicle, the geometrical description of the vehicle, a speed of the vehicle, and a direction of travel of the vehicle, the safety envelope being deformed according to the variation in the speed of the vehicle and the variation in the direction of travel of the vehicle.

44. Method according to claim 29, wherein a first level of alert warns the driver of the vehicle that a first safety distance between the vehicle and an obstacle has been breached.

45. Method according to claim 44, wherein a second level of alert warns the driver of the vehicle that a second safety distance, less than the first safety distance, between the vehicle and an obstacle has been breached.

46. Method according to claim 45, wherein a third level of alert warns the driver of the vehicle to trigger an immediate action in order to avoid an obstacle, the distance between the vehicle and the obstacle being less than a third safety distance, less than the second safety distance.

47. Method according to claim 45, wherein a third level of alert warns the driver of the vehicle that a conflict resolution guidance is implemented by a braking and steering system, the distance between the vehicle and an obstacle being less than a third safety distance, less than the second safety distance.

48. Method according to claim 29, wherein a first conflict resolution guidance, with low deceleration rate, proposes a first speed to the driver of the vehicle to be applied and to be maintained in order to comply with a first safety distance between the vehicle and an obstacle.

49. Method according to claim 48, wherein a second guidance, with intermediate deceleration rate, proposes a second speed to the driver of the vehicle to be applied and to be maintained in order to comply with a second safety distance, less than the first safety distance, between the vehicle and an obstacle.

50. Method according to claim 49, wherein a third guidance, with high deceleration rate, proposes a third speed to the driver of the vehicle to be immediately applied in order to ensure the avoidance of an obstacle, the distance between the vehicle and the obstacle being less than a third safety distance, less than the second safety distance.

51. Method according to claim 49, wherein a third guidance, with high deceleration rate, is implemented by the braking and steering system, the distance between the vehicle and an obstacle being less than a third safety distance, less than the second safety distance.

52. Method according to claim 29, comprising a situation presentation step, the situation comprising the localized obstacles, the representation of the vehicle, one or more safety envelopes of the vehicle, the topographical data, the alerts and the conflict resolution guidance.

53. Method according to claim 29, wherein each obstacle is displayed with information on the type of data having enabled the obstacle to be localized, the type of data being:

data coming from a detection data management system;

data coming from a traffic computer;

data coming from a detection data management system combined with data coming from a traffic computer.

54. Method according to claim 29, wherein each obstacle is displayed with information on the inter-distance between the vehicle and the obstacle.

55. Method according to claim 29, wherein each information on the inter-distance between the vehicle and an obstacle is shown with information on the variation with time of the inter-distance.

56. Method according to claim 29, wherein the vehicle is an aircraft moving over an airport surface.

57. Method according to claim 29, wherein the aircraft is a pilotless aircraft.

* * * * *